US008646878B2

(12) United States Patent
Fukada et al.

(10) Patent No.: US 8,646,878 B2
(45) Date of Patent: Feb. 11, 2014

(54) INK-JET HEAD

(75) Inventors: Kazuki Fukada, Osaka (JP); Hidehiro Yoshida, Osaka (JP)

(73) Assignee: Panasonic Corporation, Osaka (JP)

( * ) Notice: Subject to any disclaimer, the term of this patent is extended or adjusted under 35 U.S.C. 154(b) by 76 days.

(21) Appl. No.: 13/345,943

(22) Filed: Jan. 9, 2012

(65) Prior Publication Data

US 2012/0182352 A1 Jul. 19, 2012

(30) Foreign Application Priority Data

Jan. 14, 2011 (JP) ..... 2011-005956
Nov. 25, 2011 (JP) ..... 2011-257689

(51) Int. Cl.
*B41J 2/04* (2006.01)
*B41J 2/05* (2006.01)
*B41J 2/045* (2006.01)

(52) U.S. Cl.
USPC ..... 347/54; 347/65; 347/68

(58) Field of Classification Search
USPC ..... 347/54, 65, 68, 89, 84
See application file for complete search history.

(56) References Cited

U.S. PATENT DOCUMENTS 6,137,510 A 10/2000 Sato et al.
7,252,370 B2 * 8/2007 Hirota ..... 347/68
2005/0093931 A1 5/2005 Kodama
2008/0030556 A1 2/2008 Sugahara
2009/0167820 A1 * 7/2009 Kato et al. ..... 347/65

FOREIGN PATENT DOCUMENTS

| | | | |
|---|---|---|---|
| EP | 1077331 | A2 | 2/2001 |
| JP | 10-146976 | A | 6/1998 |
| JP | 2000-043252 | A | 2/2000 |
| JP | 2001-121693 | A | 5/2001 |
| JP | 2005-119287 | A | 5/2005 |
| JP | 2008-55896 | A | 3/2008 |
| JP | 2009-126012 | A | 6/2009 |
| JP | 2010-089402 | A | 4/2010 |
| JP | 2012-061717 | A | 3/2012 |

* cited by examiner

*Primary Examiner* — Lisa M Solomon
(74) *Attorney, Agent, or Firm* — Pearne & Gordon LLP

(57) ABSTRACT

Disclosed is an ink-jet head that can suppress occurrence of the crosstalk and facilitate a smooth ink circulation in pressure chambers. The ink jet head includes two or more pressure chambers 110 configured to be supplied with ink and each having a nozzle; ink supply channel 101 communicating with each of pressure chambers 110 and configured to allow the ink to flow to each of pressure chambers 110; ink discharge channel 102 communicating with each of pressure chambers 110 and configured to allow the ink discharged from each of pressure chambers 110 to flow; ink inlet channel 107 connecting each of pressure chambers 110 to ink supply channel 102; ink outlet channel 108 connecting each of pressure chambers 110 to ink discharge channel 102. An inner surface of ink outlet channel 108 includes unevenness 109.

17 Claims, 12 Drawing Sheets

INK-JET HEAD

This application is entitled and claims the benefit of Japanese Patent Application No. 2011-005956, filed on Jan. 14, 2011, and Japanese Patent Application No. 2011-257689, filed on Nov. 25, 2011, the disclosure of which including the specification, drawings and abstract is incorporated herein by reference in their entirety.

TECHNICAL FIELD

The present invention relates to an ink-jet head for ejecting ink.

BACKGROUND ART

A drop-on-demand ink-jet head is known as an ink-jet head that can eject, in response to the input signal, required amounts of ink droplets only when they are needed to print on the medium. In particular, extensive research is being undertaken on the piezoelectric (piezo) drop-on-demand ink-jet head since it is capable of well controlled ejection of a wide variety of inks. The drop-on-demand piezoelectric ink-jet head generally includes an ink supply channel, multiple pressure chambers, each of the pressure chambers has a nozzle and is connected to the ink supply channel, and piezoelements for applying pressure to ink filling the pressure chamber.

In the piezoelectric ink-jet head, piezoelectric elements deform by application of a drive voltage, whereby a pressure is applied to the ink in the pressure chamber, causing ink droplets to be ejected through nozzles. Broadly, there are three types of piezoelectric ink-jet head according to the manner in which the piezoelectric elements deform: share-mode, push-mode, and bend-mode. In particular, because of its ability to produce high power at low voltage, the bend-mode piezoelectric ink-jet head using multilayer piezoelements is expected to be further developed for use in manufacture of electronic devices such as organic EL displays and liquid crystal panels (for example, see Patent Literature 1).

Ink jet heads sometimes encounter the problem of failing to accurately eject ink droplets due to air inclusion or nozzle clogging. To overcome the above problem, a technique is known where an ink-jet head includes an ink discharge channel that communicates with pressure chambers and is configured to allow ink discharged from the pressure chambers to flow in order to feed ink from an ink supply channel to the ink discharge channel via the pressure chambers to circulate the ink (for example, see Patent Literature 2).

FIG. 1 is a schematic diagram of an ink-circulating ink-jet head disclosed in Patent Literature 2. As shown in FIG. 1, the ink-jet head disclosed in Patent Literature 2 includes ink supply channel 10, ink discharge channel 11, and pressure chambers 12A to 12C. Each of pressure chambers 12A to 12C communicates with ink supply channel 10 and ink discharge channel 11. In other words, pressure chambers 12A to 12C communicate with ink supply channel 10 via communication ports 16A to 16C, respectively, and communicate with ink discharge channel 11 via communication ports 17A to 17C, respectively. Further, actuators 13A to 13C are arranged in pressure chambers 12A to 12C, where nozzles 14A to 14C are formed, respectively.

As shown in FIG. 1, ink is supplied from ink supply port 50 and flows in ink supply channel 10 to be supplied to pressure chambers 12A to 12C. Part of the ink supplied to pressure chambers 12A to 12C is ejected as droplets through nozzles 14A to 14C by an action of actuators 13A to 13C, respectively, and the remaining ink is supplied to ink discharge channel 11 to be discharged from ink discharge port 51.

By feeding the ink from the ink supply channel to the ink discharge channel in this way, new ink is constantly supplied to the pressure chambers, preventing the problem of failing to accurately eject ink droplets due to air inclusion or nozzle clogging.

Further, a technique is known where an ink-jet head includes an ink common chamber (ink supply channel) having unevenness on an inner surface of the ink common chamber in order to prevent a pressure wave in the pressure chamber generated by an action of the actuator from propagating in the ink common chamber to affect another pressure chambers (for example, see Patent Literatures 3 to 5). By providing the unevenness on the inner surface of the ink common chamber in this way, a pressure wave propagated from pressure chambers to the ink common chamber can be attenuated. Further, a technique is known where unevenness is provided in the ink common chamber from a viewpoint of reducing the number of the actuators in the ink common chamber (for example, see Patent Literatures 6 and 7). Further, a technique of providing unevenness in the pressure chambers is also known to prevent bubbles from reaching the nozzles (for example, see Patent Literatures 8 and 9).

CITATION LIST

Patent Literature

PTL 1
Japanese Patent Application Laid-Open No. 2001-121693
PTL 2
Japanese Patent Application Laid-Open No. 2009-126012
PTL 3
Japanese Patent Application Laid-Open No. 2000-43252
PTL 4
Japanese Patent Application Laid-Open No. 2008-55896
PTL 5
U.S. Patent Application Publication No. 2008/0030556
PTL 6
Japanese Patent Application Laid-Open No. 2005-119287
PTL 7
U.S. Patent Application Publication No. 2005/0093931
PTL 8
Japanese Patent Application Laid-Open No. 10-146976
PTL 9
U.S. Pat. No. 6,137,510

SUMMARY OF INVENTION

Technical Problem

However, when the ink discharge channel communicating with the pressure chambers is provided as disclosed in Patent Literature 2, a pressure wave generated in one pressure chamber by an action of the actuator may propagate in the ink discharge channel. In the ink-circulating ink-jet head as disclosed in Patent Literature 2, ink flows in the pressure chambers toward the ink discharge channel, so that a pressure wave generated in the pressure chambers by an action of the actuator tends to propagate into the ink discharge channel with the ink flow.

The pressure wave that has propagated into the ink discharge channel then propagates in another pressure chambers, affecting ink ejection in such pressure chambers. As described above, a phenomenon in which a pressure wave generated in a pressure chamber affects ink ejection in another pressure chambers is called as "crosstalk." When the crosstalk occurs, a volume of ink droplets to be ejected may vary and ejection intervals of ink may become unstable among the pressure chambers.

For this reason, in the conventional ink-circulating ink-jet head, accurate ink ejection is difficult due to the crosstalk. In contrast, providing the unevenness on the inner surface of the ink common chamber (ink supply channel or ink discharge channel) as disclosed in Patent Literatures 3 to 5 may suppress occurrence of the crosstalk.

However, the method of providing the unevenness on the inner surface of the ink common chamber to attenuate a pressure wave that has propagated from a pressure chamber to the ink common chamber as disclosed in Patent Literatures 3 to 5 cannot prevent the pressure wave that has generated in one pressure chamber from propagating in the ink common chamber. When the pressure wave that has generated in the pressure chamber propagates in the ink common chamber, a pressure of the ink common chamber becomes unstable, in which the ink may not be supplied stably to another pressure chambers, and ink circulation and ink ejection in another pressure chambers may become unstable.

In view of the above, it is therefore an object of the present invention to provide an ink-circulating ink-jet head that can suppress occurrence of the crosstalk and facilitate smooth ink circulation in the pressure chambers.

Solution to Problem

The present inventors found out that providing unevenness on an inner surface of an ink outlet channel, connecting each of the pressure chambers and an ink discharge channel, can suppress occurrence of the crosstalk among the pressure chambers and stabilize a pressure in the ink discharge channel, and further studied to complete the development of the present invention.

Therefore, the present invention relates to the ink-jet head given below.

[1] An ink-jet head comprising, two or more pressure chambers configured to be supplied with ink and each having a nozzle for injecting the ink;

an ink supply channel communicating with each of the pressure chambers and configured to allow the ink to flow to each of the pressure chambers;

an ink discharge channel communicating with each of the pressure chambers and configured to allow the ink to flow, the ink being discharged from each of the pressure chambers;

an ink inlet channel connecting each of the pressure chambers to the ink supply channel;

an ink outlet channel connecting each of the pressure chambers to the ink discharge channel;

an actuator arranged in each of the pressure chambers and for applying pressure to the ink in each of the pressure chambers;

wherein an inner surface of the ink outlet channel has unevenness.

[2], The ink-jet head according to [1], wherein an inner surface of the ink inlet channel has unevenness.

[3] The ink-jet head according to any one of [1] or [2], wherein the unevenness is made of an elastic member.

[4]. The ink-jet head according to any one of [1] to [3], wherein the ink inlet channel and the ink outlet channel are straight, and a connection section connecting the ink inlet channel and each of the pressure chambers and a connection section connecting the ink outlet channel and each of the pressure chambers face each other, and a line passing through the ink inlet channel also passes through the ink outlet channel.

[5] The ink-jet head according to any one of [1] to [4], wherein the ink inlet channel and the ink outlet channel are formed in a shape so that an energy loss of the ink flowing out from each of the pressure chambers is higher than an energy loss of the ink flowing into each of the pressure chamber.

[6] An ink-jet apparatus comprising the ink-jet head according to any one of [1] to [5].

Advantageous Effects of Invention

According to the present invention, occurrence of the crosstalk among the pressure chambers can be suppressed and ink can be smoothly circulated in the pressure chambers.

DESCRIPTION OF EMBODIMENTS

1. Ink-Jet Head of the Present Invention

An ink-jet head of the present invention is a piezoelectric drop-on-demand ink-jet head having multiple pressure chambers.

A drop-on-demand ink-jet head that can eject, in response to the input signal, required amounts of ink droplets only when they are needed to print on the medium. The ink-jet head of the present invention is of ink-circulating type in which ink flows in the pressure chambers.

The ink-jet head of the present invention includes 1) multiple pressure chambers, 2) an ink supply channel, 3) au ink discharge channel, 4) multiple actuators, and 5) ink inlet channels and ink outlet channels. Each component of the ink-jet apparatus will be described below.

1) Pressure Chamber

The pressure chambers communicate with the ink supply channel via the ink inlet channel, respectively, and are supplied with ink from the ink supply channel. The maximum number of the pressure chambers to communicate with one ink supply channel is normally 1,024. Multiple pressure chambers are normally arranged in a row, and the pressure chambers do not communicate directly with one another. The interval between the adjacent pressure chambers is 50-200 μm.

Each of the pressure chambers has a nozzle for ejecting the supplied ink. The nozzle is a ejection port to communicate with outside. One pressure chamber may include one or more nozzles. The ink in the pressure chamber is ejected through the nozzle to outside. The diameter of the nozzle is not particularly limited, and may be around 10-100 μm, for example, and may be around 20 μm.

Figure 1:
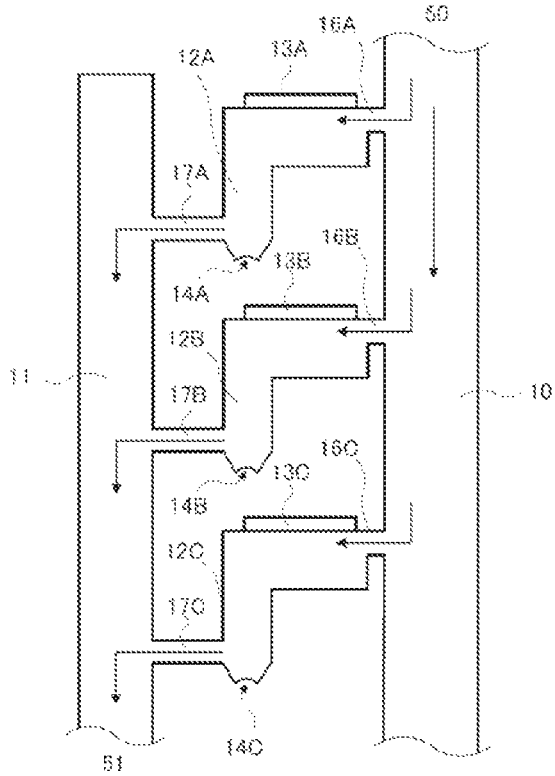
FIG. 1 is a schematic diagram of a conventional ink-jet apparatus.
Figure 2:
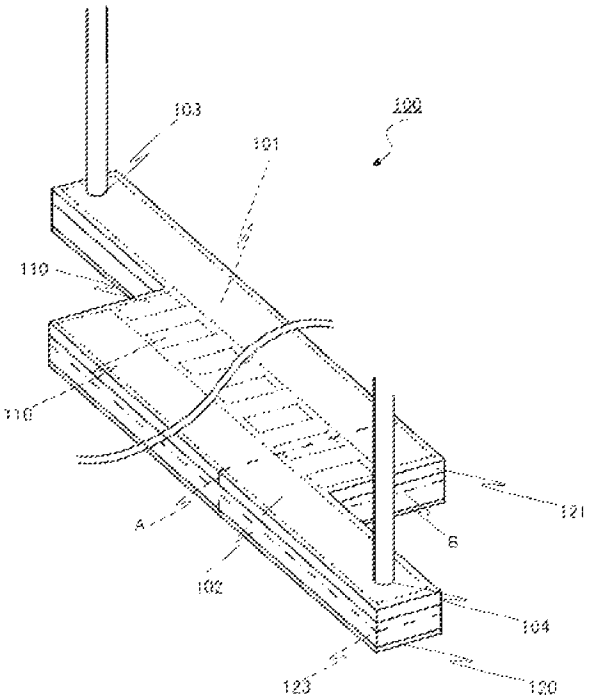
FIG. 2 is a perspective view of the ink-jet head according to Embodiment 1.

Each of the pressure chambers is formed by bonding a nozzle plate constituting a bottom surface of the pressure chamber, an upper plate constituting an upper surface of the pressure chamber, and spacers constituting side surfaces of the pressure chamber that are sandwiched by the nozzle plate and the upper plate (see FIG. 2). Here, the side surface of the pressure chamber refers to a surface parallel to the ink ejection direction, out of the wall surfaces of the pressure chamber.

2) Ink Supply Channel

The ink supply channel communicates with each of the pressure chambers via the ink inlet channel, and is configured to allow an ink to flow to the pressure chambers. The ink supply channel includes an ink feed port to which the ink is supplied from outside. An ink flow rate in the ink supply channel is not particularly limited, and may be several mL/min or greater. The ink flowing in the ink supply channel is divided and supplied to each of multiple pressure chambers.

The type of the ink flowing in the ink supply channel is not particularly limited, and is selected according to the type of a product to be obtained by application of the ink. For example, when the product is an organic EL panel or a liquid crystal panel, examples of the ink include a high viscous ink such as a solution containing organic luminescent substances, such as electroluminescent materials.

3) Ink Discharge Channel

The ink discharge channel communicates with each of the pressure chambers via the ink outlet channel, and is configured to allow ink discharged from the pressure chamber to flow. Each of the pressure chambers and the ink discharge channel are connected by an ink outlet channel. Normally, the ink discharge channel is connected so as to supply the ink to the ink supply channel. The ink discharge channel may include an ink discharge port for discharging ink to outside. Further, the ink flow direction in the ink discharge channel is normally parallel to the ink flow direction in the ink supply channel.

4) Actuator

The actuator is an actuating device for converting control signals including a drive voltage into actual movement to apply pressure to the ink in each of the pressure chambers.

The actuator of the present invention may be a thin film piezoelement or multilayer piezoelement, with the multilayer piezoelement being preferable. The thin film piezoelement shows a faster output response to input, but tends to show low output. Therefore, an action of the thin film piezoelement tends to vary depending on viscosity of the ink to be ejected.

On the other hand, the multilayer piezoelement shows a slow output response to input, but tends to show greater output. Therefore, the multilayer piezoelement is unlikely to be subjected to the influence of the viscosity of the ink to be ejected, and therefore can be driven stably. The height of the multilayer piezoelement (length in the direction in which layers are stacked) is normally 100-1,000 μm.

The multilayer piezoelement may be made by stacking multiple sheets of lead zirconate titanate (PZT) and conductive films on a piezo-mounting plate to make an assembly, and dividing the assembly. For dividing the assembly, a dicing apparatus having a rotating blade may be used.

The actuator deforms a wall surface of each of the pressure chambers. Deforming of a wall surface of the pressure chamber by the actuator controls pressure in the pressure chamber. By this means, the ink is fed to the pressure chamber and the ink is ejected through the nozzle. The wall surface of the pressure chamber to be deformed by the actuator may be an upper surface or a side surface.

The wall surface of the pressure chamber to be deformed by the actuator may be constituted by a vibration plate (diaphragm). Further, the top surface of the actuator may constitute a wall surface of the pressure chamber.

5) Ink Inlet Channel and Ink Outlet Channel

Each of the ink inlet channels connects the ink supply channel and the pressure chamber; and each of the ink outlet channels connects the pressure chamber and the ink discharge channel. More specifically, the ink inlet channel refers to a region of an ink channel connecting the ink supply channel and the pressure chamber in which an area of the cross section (cross section perpendicular to the ink flow direction) (hereinafter also simply referred to as "cross-sectional area") is smaller than the cross sectional area of the pressure chamber; and the ink outlet channel refers to a region of an ink channel connecting the pressure chamber and the ink discharge channel in which the cross-sectional area is smaller than the cross sectional area of the pressure chamber. Further, a region having the smallest cross-sectional area in the ink inlet channel and the ink outlet channel is also called as "orifice."

The ink inlet channel and the ink outlet channel may be bent or straight, with a straight channel being preferable. When the ink inlet channel and the ink outlet channel are bent, channel resistance of such channels increases, thus, a smooth circulation of the ink in the ink-jet head may be impaired.

The length of the ink inlet channel is not particularly limited and may be 0.5-5.0 mm, for example. Likewise, the length of the ink outlet channel is not particularly limited and may be 0.5-4.0 mm, for example.

Further, the cross-sectional area of the ink outlet channel may be the same as that of the ink inlet channel, but the cross-sectional area of the ink outlet channel is preferably smaller than that of the ink inlet channel (see FIG. 3). Specifically, the cross-sectional areas of the ink inlet channel and the ink outlet channel are preferably 1,000-7,500 $\mu m^2$ and 500-5,000 $\mu m^2$, respectively, and the cross-sectional area of the ink outlet channel is preferably 500-2,500 $\mu m^2$ smaller than that of the ink inlet channel.

By making the cross-sectional area of the ink outlet channel smaller than that of the ink inlet channel in this way, the channel resistance of the ink outlet channel can be made greater than that of the ink inlet channel. Accordingly, it is possible to prevent the ink from back flowing from the ink outlet channel to the pressure chambers.

The relationship of relative positions of a section connecting the pressure chamber with the ink inlet channel (hereinafter also referred to as "inlet connection section") and a section connecting the pressure chamber with the ink outlet channel (hereinafter also referred to as "outlet connection section") is not particularly limited. For example, the outlet connection section may be positioned nearer the nozzle side than the inlet connection section (see Embodiment 1), and the inlet connection section and the outlet connection section may face each other (see Embodiment 2).

According to the present invention, an inner surface of the ink outlet channel has unevenness. Further, according to the present invention, it is preferable that an inner surface of the ink inlet channel also have unevenness (see Embodiment 2).

By providing unevenness on the inner surface of the ink outlet channel in this way, a pressure wave generated in the pressure chamber by an action of the actuator can be attenuated by the unevenness on the inner surface of the ink outlet channel, preventing the pressure wave from propagating in the ink discharge channel.

The height and width of a projection of the unevenness are 1-30 μm and 1-100 μm, respectively, for example. The unevenness may be arranged on the entire inner surface of the ink outlet channel, but the length of a region of the ink outlet channel, in which the unevenness is arranged (hereinafter also simply referred to as "unevenness region"), is preferably 100-200 μm (see reference sign 109L' of FIG. 5A). When the length of the unevenness region is less than 100 μm, there is a likelihood that a pressure wave generated in the pressure chamber is not sufficiently attenuated by the unevenness. On the other hand, when the length of the unevenness region is over 200 μm, a pressure loss of the ink outlet channel increases, so that there is a likelihood that the ink is hard to flow from the pressure chamber to the ink discharge channel, causing ink retention in the pressure chamber.

To provide the unevenness on the inner surface of the ink outlet channel, the inner surface itself of the ink outlet channel may be processed, or a film having the unevenness may be attached to the inner surface of the ink outlet channel. To provide the unevenness on the inner surface of the ink outlet channel by processing the inner surface itself of the ink outlet channel, for example, it is only necessary to roughen a desired region of the inner surface of the ink outlet channel by, for example, blasting. Further, the film having the unevenness is preferably made by processing a film surface made of an elastic member. In other words, the unevenness is preferably made of an elastic member. This is because unevenness made of an elastic member have a high capacity of absorbing a pressure wave, attenuating the pressure wave more effectively. Elastic members include rubbers and plastic or asphalt polymer materials.

As described above, according to the present invention, a pressure wave that has generated in the pressure chamber is prevented from propagating in the ink discharge channel, preventing the pressure wave that has generated in the pressure chamber from propagating in another pressure chambers. For this reason, according to the present invention, the crosstalk among the pressure chambers is small.

Further, a pressure wave is prevented from propagating in the ink discharge channel so that pressure is stabilized in the ink discharge channel. Therefore, according to the present invention, ink can circulate smoothly from the ink supply channel to the ink discharge channel via the pressure chambers.

In order to further increase pressure in the pressure chamber, it is preferable that the ink inlet channel and the ink outlet channel are formed in such a shape so that an energy loss of the ink flowing out from the pressure chamber is higher than an energy loss of the ink flowing into the pressure chamber.

These ink inlet channel and ink outlet channel (hereinafter, generically referred to as "ink channel") include, for example, a shrinking section in which the cross-sectional area of the ink channel decreases gradually toward the pressure chamber and an expanding section in which the cross-sectional area of the ink channel increases significantly toward the pressure chamber. The number of pairs of the shrinking section and the expanding section arranged in the ink channel may be single or multiple.

Here, in "a shrinking section in which the cross-sectional area of the ink channel decreases gradually toward the pressure chamber" and "an expanding section in which the cross-sectional area of the ink channel increases significantly toward the pressure chamber," a change rate of the cross sectional area in the shrinking section is lower than a change rate of the cross sectional area in the expanding section. For example, the absolute value of inclination of the shrinking section with respect to the ink channel axis is smaller than the absolute value of inclination of the expanding section. The relationship of these inclinations can be defined by the following method, for example (see FIG. 12).

Start point r1 of the shrinking section is defined as a position at which the cross-sectional area of the ink channel starts to decrease along the direction toward the pressure chamber; and end point r2 of the shrinking section is defined as a position at which the cross-sectional area of the ink channel finishes decreasing along the direction toward the pressure chamber. Further, start point s1 of the expanding section is defined as a position at which the cross-sectional area of the ink channel starts to increase along the direction toward the pressure chamber; and end point s2 of the expanding section is defined as a position at which the cross-sectional area of the ink channel finishes increasing along the direction toward the pressure chamber.

Figure 12A:
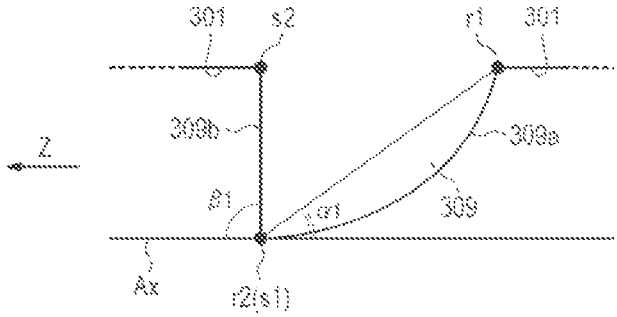
FIGS. 12A to 12C show the feature of a projection and an island according to the embodiments.
Figure 12B:
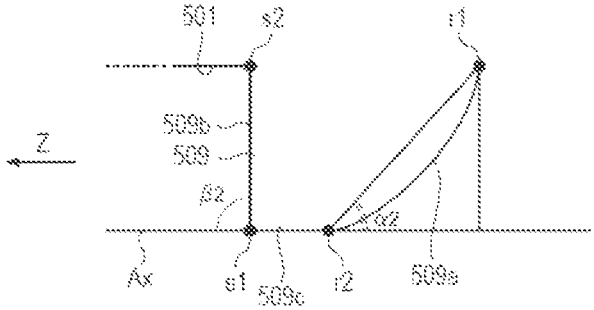
Figure 12C:
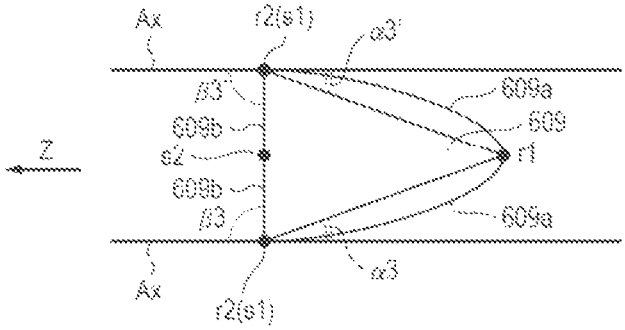

An intersection angle, at end point r2 of the shrinking section, of a line connecting start point r1 with end point r2 of the shrinking section and a straight line that is parallel to the ink channel axis, the straight line having an end point as end point r2 along the direction toward the pressure chamber, is defined as a (see FIGS. 12A to 12C). An intersection angle, at start point s1 of the expanding section, of a line connecting start point s1 with end point s2 of the expanding section and a straight line that is parallel to the ink channel axis, the straight line extending from start point s1 in the direction toward the pressure chamber, is defined as 13 (see FIGS. 12A to 12C). At this time, angle $\alpha$ is set smaller than angle $\beta$ ($\alpha<\beta$).

Angle $\alpha$ is less than 90° and angle $\beta$ is less than 180°. Angle $\alpha$ is preferably 10-80° and more preferably 30-60°. Angle $\beta$ is preferably 80-170°, and more preferably 90-120°. A difference between angle $\alpha$ and angle $\beta$ ($\beta-\alpha$) is preferably larger in order to increase pressure in the pressure chamber, with preferably 20-160° and more preferably 30-120°.

Further, in a cross section in the direction of the ink channel axis, the shrinking section is preferably formed by a straight line or a convex curved line. A feature of the expanding section in the above cross section is preferably not formed by a convex curve, but is not particularly limited.

The ink channel may further include a straight section between the shrinking section and the expanding section, the straight section forming the channel having a cross-sectional area decreased by the shrinking section. It is preferable to provide the straight section in the ink channel in order to increase pressure in the pressure chamber. In particular, in view of the above purpose, it is preferable to provide the straight section in the ink channel when there is one set of the shrinking section(s) and the expanding section(s), which makes one shrinking section.

The shrinking section and the expanding section can be formed by, for example, disposing a projection having a specific feature on side walls of the ink inlet channel and the ink outlet channel. Alternatively, the shrinking section and the expanding section can be formed by disposing an island having a specific feature in the ink inlet channel and the ink outlet channel.

The shrinking section and the expanding section may include only the shrinking section and the expanding section having the same size and the same form, or may include the shrinking section and the expanding section having different sizes or different forms.

2. Ink-Jet Apparatus of the Present Invention

An ink-jet apparatus of the present invention includes the above-described ink-jet head, and may appropriately include components of any known ink-jet apparatus. For example, the ink-jet apparatus includes a member for securing the ink-jet head and a transport stage for carrying an article to be coated with ink.

The ink-jet apparatus includes ink circulation apparatus. The ink circulation apparatus supplies a drive pressure to ink to circulate the ink. A pump may be used to supply the drive pressure to ink, but it is preferable to use a regulator for supplying a pressure using compressed air. Using a regulator makes a drive pressure constant and stabilizes an ink circulation rate.

The ink-jet apparatus may be configured so as to constantly or intermittently circulate ink in the ink-jet head during operation.

Hereinafter, embodiments of the present invention will be described with reference to the drawings, but the present invention is not particularly limited to these embodiments.

Embodiment 1

FIG. 2 is a perspective view of ink-jet head 100 according to Embodiment 1. As shown in FIG. 2, ink-jet head 100 includes ink supply channel 101, ink discharge channel 102, and multiple pressure chambers 110. Further, ink supply channel 101 includes ink feed port 103, and ink discharge channel 102 includes ink discharge port 104.

Further, ink-jet head 100 is made by bonding nozzle plate 120 having nozzles, spacers 123, and upper plate (piezo-mounting plate) 121.

Figure 3A:
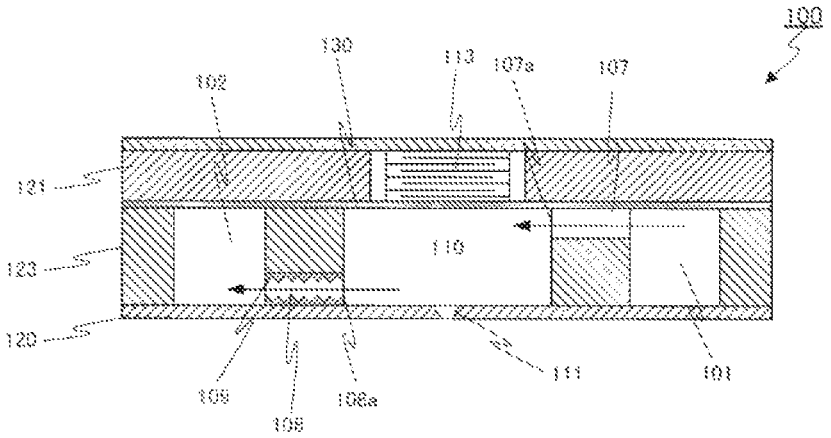
FIGS. 3A and 3B are cross-sectional views of the ink-jet head according to Embodiment 1.
Figure 3B:
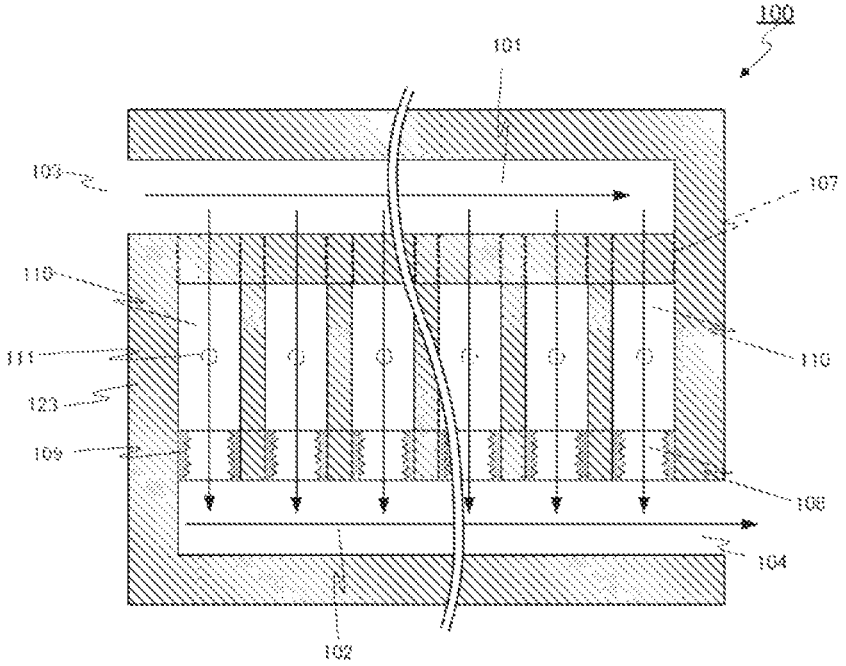

FIG. 3A is a line-A cross-sectional view of ink-jet head 100 shown in FIG. 2. FIG. 3B is a line-B cross-sectional view of ink-jet head 100 shown in FIG. 2. Arrows in FIGS. 3A and 3B indicate the ink flow direction.

As shown in FIGS. 3A and 3B, ink-jet head 100 further includes ink inlet channels 107, ink outlet channels 108, and actuators 113.

Pressure chamber 110 includes a bottom surface composed of nozzle plate 120 having nozzles 111, side surfaces composed of spacers 123, and an upper surface composed of upper plate (piezo-mounting plate) 121. Actuator 113 vibrates vibration plate 130 constituting the upper surface of pressure chamber 110.

Pressure chamber 110 communicates with ink supply channel 101 via ink inlet channel 107, and communicates with ink discharge channel 102 via ink outlet channel 108. Ink inlet channel 107 and ink outlet channel 108 are straight, not being bent.

Inlet connection section 107*a* connecting pressure chamber 110 and ink inlet channel 107 and outlet connection section 108*a* connecting pressure chamber 110 and ink outlet channel 108 are provided on a side surface of pressure chamber 110, respectively.

Figure 4:
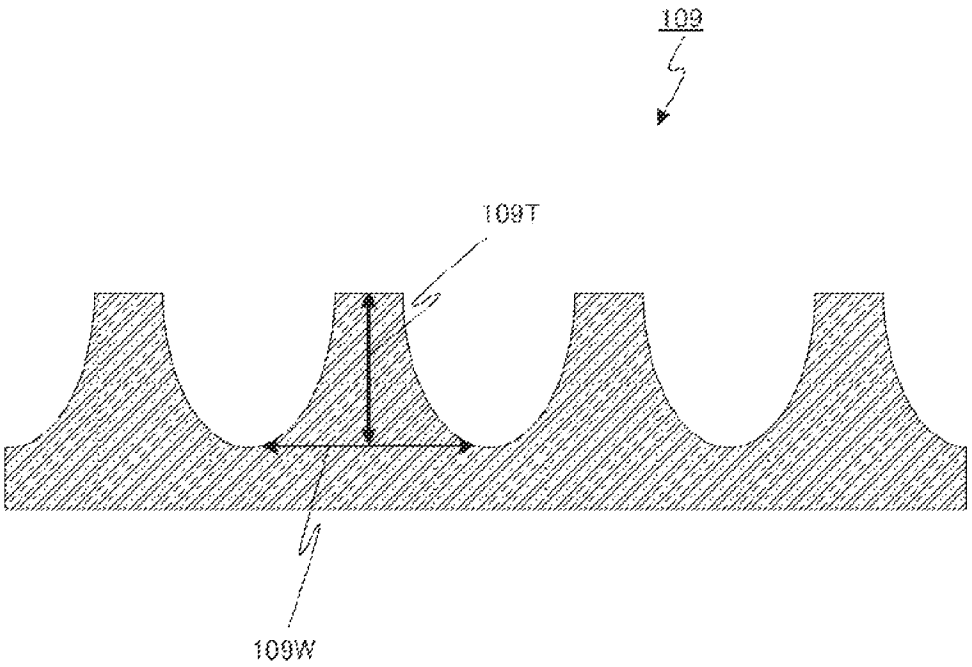
FIG. 4 is a partially enlarged cross-sectional view of the ink-jet head according to Embodiment 1.

As shown in FIGS. 3A and 3B, unevenness 109 is provided on an inner surface of ink outlet channel 108. FIG. 4 is an enlarged view of unevenness 109 provided on an inner surface of ink outlet channel 108.

In unevenness 109, height 109T and width 109W of a projection are preferably 1-30 μm and 1-100 μm, respectively.

Next, an operation of ink-jet head 100 of the present embodiment will be described with reference to FIGS. 3A and 3B.

First, ink is supplied from an ink tank (not shown) to ink supply channel 101. The ink tank preferably has a pressure control mechanism (not shown). By providing a pressure control mechanism in the ink tank, even when the ink is consumed in the ink tank and thus the ink liquid level in the ink tank lowers, the ink can be supplied at a constant pressure from the ink tank to ink supply channel 101. The pressure control mechanism may control the height of the ink tank to make the ink liquid level constant, to make a pressure of the ink to be supplied constant.

After being supplied to ink supply channel 101, the ink is supplied to pressure chamber 110 via ink inlet channel 107. After being supplied to pressure chamber 110, the ink passes through ink outlet channel 108 to be discharged into ink discharge channel 102. Therefore, the ink flows from inlet connection section 107*a* to outlet connection section 108*a* through pressure chamber 110. In this way, a new ink is constantly supplied to pressure chamber 110.

Next, a drive voltage is applied to actuator 113. By this means, actuator 113 extends to push vibration plate 130 in the ink ejection direction X, reducing a volume of pressure chamber 110. By this means, the ink in pressure chamber 110 receives a pressure in the ejection direction X, to be ejected through nozzle 111.

On the other hand, part of a pressure wave generated by the action of actuator 113 joins the ink flow in pressure chamber 110 to propagate in ink outlet channel 108. However, the pressure wave that has propagated in ink outlet channel 108 is absorbed or attenuated by unevenness 109 arranged in the inner surface of ink outlet channel 108, and will not propagate in ink discharge channel 102. For this reason, the pressure wave that has generated in one pressure chamber 110 does not propagate in another pressure chambers 110. Therefore, according to the present embodiment, it is possible to suppress occurrence of the crosstalk due to the pressure wave.

Further, the pressure wave does not propagate in ink discharge channel 102, stabilizing the pressure in ink discharge channel 102. For this reason, the ink can flow smoothly in pressure chamber 110 and circulate smoothly in the ink-jet head 100.

When a drive voltage of actuator 113 is stopped after ink ejection, the actuator contracts, increasing a volume of pressure chamber 110. When the volume of pressure chamber 110 increases, the pressure in pressure chamber 110 lowers, facilitating ink supply to pressure chamber 110.

FIG. 3A shows an embodiment where ink inlet channel 107 and ink outlet channel 108 are not positioned on the same line. However, according to the present embodiment, ink inlet channel 107 and ink outlet channel 108 may be positioned on the same line at any positions between vibration plate 130 and nozzle plate 120. In that case, it is possible to further achieve an effect of smoother ink circulation (described later).

Embodiment 2

Embodiment 1 describes an embodiment where only the inner surface of the ink outlet channel has unevenness. Embodiment 2 will describe an embodiment where the inner surfaces of the ink outlet channel and the ink inlet channel have unevenness.

Figure 5A:
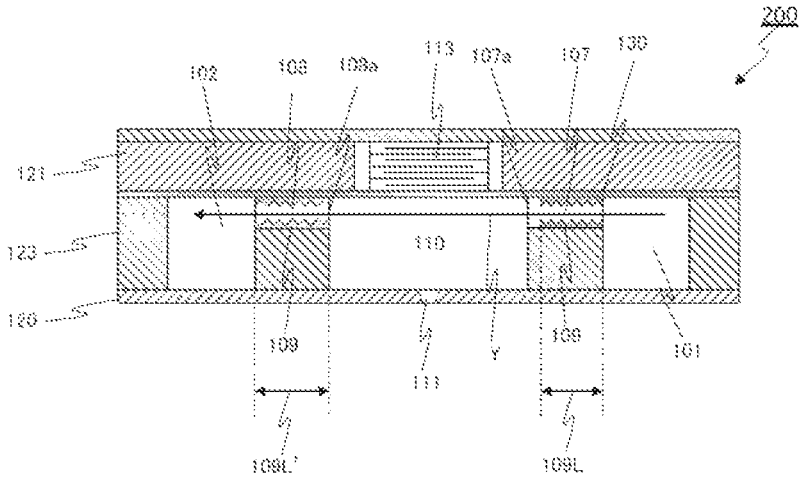
FIGS. 5A and 5B are cross-sectional views of an ink-jet head according to Embodiment 2.
Figure 5B:
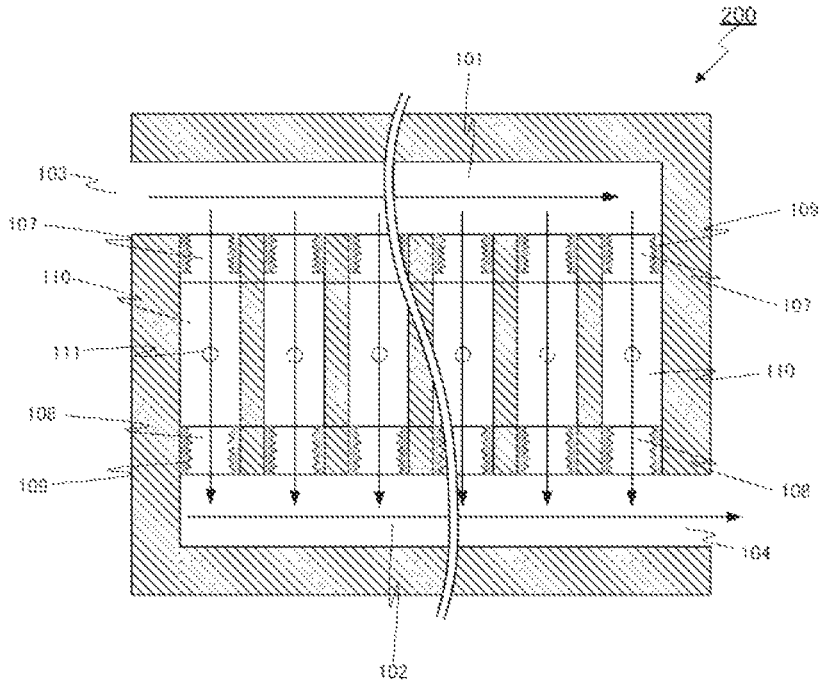

FIG. 5A is a line-A cross-sectional view of ink-jet head 200 according to Embodiment 2 (see FIG. 2), and FIG. 5B is a line-B cross-sectional view of ink-jet head 200 according to Embodiment 2 (see FIG. 2). An explanation of components identical to those of ink-jet head 100 of Embodiment 1 is omitted.

As shown in FIGS. 5A and 5B, in ink-jet head 200, unevenness 109 is provided also on an inner surface of ink inlet channel 107. By providing unevenness 109 not only on the inner surface of ink outlet channel 108 but also on the inner surface of ink inlet channel 107 in this way, a pressure wave generated in pressure chamber 110 can be prevented from propagating in the ink supply channel. By this means, compared to Embodiment 1, the crosstalk among the pressure chambers can be further suppressed and the ink can circulate further smoothly.

Length 109L of a region of ink inlet channel 107 in which unevenness 109 is provided may be the same as length 109L' of a region of ink outlet channel 108 in which unevenness 109 is provided, with 109L being preferably shorter than 109L' according to the present embodiment (see FIG. 5A). Specifically, 109L and 109L' are preferably 50-150 μm and 100-200 μm, respectively.

As described above, with an ink-circulating ink-jet head such as the present invention, because ink flows from ink inlet channel 107 to ink outlet channel 108 via the pressure chamber, so that a pressure wave generated in pressure chamber 110 needs to back flow against the ink flow in order to propagate in ink inlet channel 107. For this reason, it is hard to propagate the pressure wave generated in pressure chamber 110 into ink inlet channel 107. Therefore, even when length 109L of the region of ink inlet channel 107 in which unevenness 109 is provided is short, a pressure to be propagated in ink inlet channel 107 can be sufficiently attenuated. Further, by shortening 109L, a pressure loss of ink inlet channel 107 can be reduced and the ink can circulate smoothly.

Further, according to the present embodiment, ink inlet channel 107 and ink outlet channel 108 are straight, not being bent. Further, line Y passing through ink inlet channel 107 also passes through ink outlet channel 108.

As described above, by positioning ink inlet channel 107 and ink outlet channel 108 on the same line, the ink can flow smoothly from ink inlet channel 107 to ink outlet channel 108. By this means, the ink circulates more smoothly in the ink-jet apparatus, facilitating the ink circulation in the ink-jet head with a low circulate pressure even when a high viscous ink is supplied.

By this means, according to the present embodiment, the ink can circulate more smoothly, effectively suppressing generation of foreign matters in the ink or occurrence of nozzle clogging.

FIG. 5A shows an embodiment where ink inlet channel 107 and ink outlet channel 108 are positioned on the same line. However, according to the present embodiment, ink inlet channel 107 and ink outlet channel 108 may not be on the same line so long as they are positioned in any positions between vibration plate 130 and nozzle plate 120. In that case, it is possible to achieve the effects except for the above-described effect of the smoother ink circulation.

Embodiment 3

Embodiment 3 describes an embodiment where inner surfaces of the ink inlet channel and ink outlet channel have projections of a specific feature.

Figure 6A:
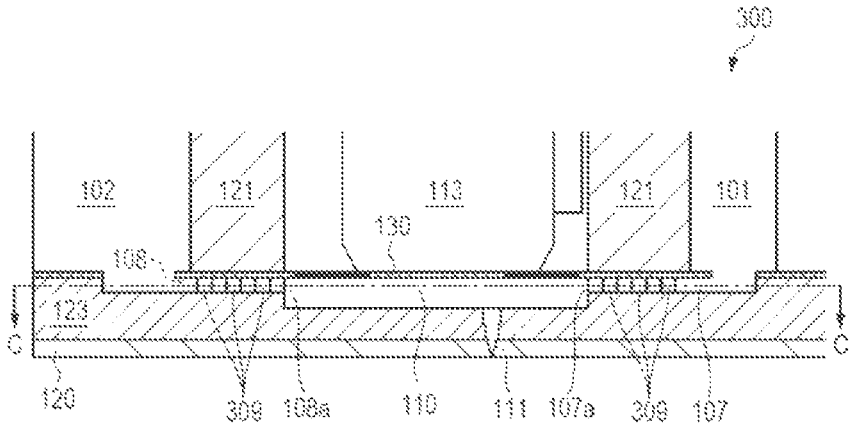
FIGS. 6A to 6C show an ink-jet head according to Embodiment 3.
Figure 6B:
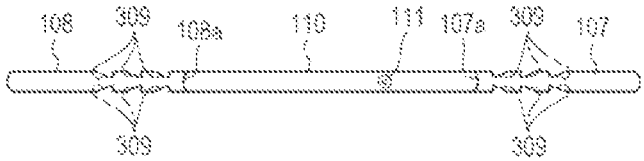

FIG. 6A is a line-A cross-sectional view of ink-jet head 300 according to Embodiment 3 (see FIG. 2). FIG. 6B is a line-C cross-sectional view of ink-jet head 300 of FIG. 6A according to Embodiment 3. An explanation of components identical to those of ink-jet head 100 of Embodiment 1 is omitted.

Figure 6C:
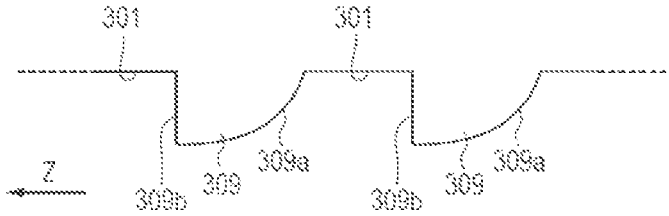

As shown in FIGS. 6A and 6B, each of ink inlet channel 107 and ink outlet channel 108 of ink-jet head 300 has multiple projections 309 arranged on a planar internal wall surface (reference sign 301 of FIG. 6C). Projections 309 are arranged intermittently along the direction of the ink channel axis. As shown in FIG. 6C, projection 309 includes inclining section 309*a* gradually reducing a width of the channel in a planar direction (FIG. 6B) of the ink channel toward pressure chamber 110, and widening section 309*b* increasing significantly the width of the channel. Arrow Z in FIG. 6C indicates a direction of pressure chamber 110.

As shown in FIG. 6B, projections 309 are arranged on each of internal wall surfaces 301, which make a pair, of the ink channel. Projections 309 on one internal wall surface 301 and projections 309 on the other internal wall surface 301 are arranged so that inclining sections 309*a* on the pair of internal wall surfaces face each other and widening sections 309*b* on the pair of internal wall surfaces face each other.

Inclining section 309*a* constitutes a convexedly curved surface on internal wall surface 301 of the ink chamber channel. Inclining section 309*a* constitutes the above-described shrinking section. Widening section 309*b* is formed between an end of inclining section 309*a* at pressure chamber 110 side and internal wall surface 301 of the ink channel. Widening section 309*b* constitutes a plane in the cross section of the ink channel. Widening section 309*b* constitutes the above-described expanding section.

Here, as shown in FIG. 12A, the start point and the end point of inclining section 309*a* in the Z direction are defined as r1 and r2, respectively. Further, the start point and the end point of widening section 309*b* in the Z direction are defined as s1 and s2, respectively. However, in projection 309, the end point of inclining section 309*a* and the start point of widening section 309*b* share the same point. Intersection angle α1 at end point r2 of the line connecting r1 with r2 and part of straight line Ax that is parallel to the ink flow axis, the part of the straight line Ax having end point r2 as the end point in the Z direction, is 30°, for example. Further, intersection angle β1 at start point s1 of the line connecting s1 with s2 and part of the straight line Ax, the part of the straight line Ax extending from s1 in the Z direction, is 90°. Further, as described above, inclining section 309*a* is formed by a convexedly curve line, and widening section 309*b* is formed by a straight line.

When β1 exceeds 90°, end point s2 of widening section 309*b* is positioned upper stream relative to start point s1 in the Z direction, which is also called "start point s1 and end point s2 of widening section 309*b* in the Z direction."

The ink channel can be formed by cutting spacer 123 in the same way as with pressure chamber 110. When forming the ink channel, projection 309 can be formed by, for example, cutting spacer 123 so that the wall surface of the ink channel has projection 309. The height of a protrusion of projection 309 (distance from internal wall surface 301 of the ink channel to the end of pressure chamber 110 side of the inclining section 309*a* in the width direction of the ink channel) is 0.25-2.0 times the width of the ink channel, for example.

Generally, when a fluid flows through a pipe, a head loss of the fluid can be determined by the following equation, where ξ represents a loss coefficient, $u_m$ represents average fluid flow rate in the pipe, g represents gravitational acceleration. ξ varies depending on the channel shape.

$$\Delta h = \zeta \frac{u_m}{2g}$$

Among the features formed on a wall surface of the channel, a feature having a surface perpendicular in the flow direction of the channel has a high loss coefficient. For example, a loss coefficient at a connection section is 0.5 when a first pipe having pipe diameter $A_1$ and a second pipe having pipe diameter $A_1/2$ are directly connected. In contrast, a loss coefficient of the connection section of a shape having a convexedly curved surface is significantly small. For example, a loss coefficient of the connection section is 0.005-0.06 when the first pipe and the second pipe are connected via a curved wall having a cross section of a convexedly arc shape.

The ink channel includes arc-shaped inclining section 309*a* protruding gradually toward pressure chamber 110 and widening section 309*b* forming a surface in the cross section of the ink channel that faces pressure chamber 110. Therefore, in ink inlet channel 107 and ink outlet channel 108, an energy loss of the ink flowing out toward pressure chamber 110 is small and an energy loss of the ink flowing out from pressure chamber 110 is large.

In ink-jet head 300, the ink is allowed to flow by making a pressure in ink inlet channel 107 higher than a pressure in ink outlet channel 108. After flowing through ink inlet channel 107, the ink enters pressure chamber 110. In ink inlet channel 107, since the ink flows along inclining section 309*a*, the ink easily flows to pressure chamber 110.

Deforming pressure chamber 110 by actuator 113 increases pressure in pressure chamber 110. Each of ink inlet channel 107 and ink outlet channel 108 has widening sections 309*b* facing pressure chamber 110. Accordingly, the ink in pressure chamber 110 is hard to flow into either of ink inlet channel 107 and ink outlet channel 108. For this reason, a pressure elavated in pressure chamber 110 is prevented from being transmitted to outside via the ink channel. Therefore, the pressure in the pressure chamber 110 elevated by actuator 113 is hard to leak. Such a pressure in pressure chamber 110 makes the ink eject through nozzle 111.

For example, in an ink-circulating ink-jet head without projections in the ink channel, in order to eject ink through nozzles correctly, it is necessary to ensure an ink circulation flow rate of 1-50 μL/min per nozzle. This ink circulation flow rate has been experimentally confirmed. At this ink circulation flow rate, when deformation by actuator 113 is set to 100-500 nm, a pressure in pressure chamber 110 becomes 1.0-2.5 MPa. This pressure is determined by simulation. Under this condition, when the projections are provided in the ink channel, a pressure in pressure chamber 110 becomes 1.3-4.5 MPa. By providing the projections in the ink channel in this way, a pressure of pressure chamber 110 can be further increased at predetermined ink circulation flow rate of 1-50 μm/min.

The present embodiment provides an effect of increasing a pressure of the pressure chamber by 1.5 to 2 times at the same ink circulation flow rate, in addition to the effects of Embodiment 2.

Embodiment 4

Figure 7A:
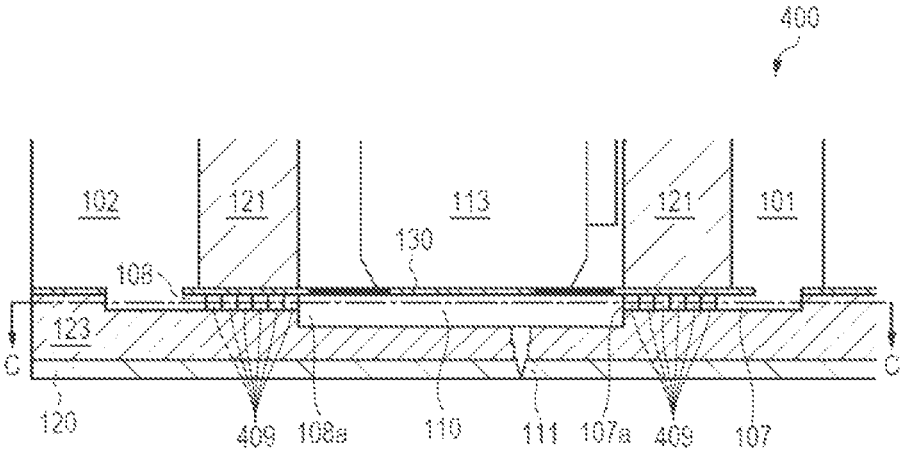
FIGS. 7A to 7C show an ink-jet head according to Embodiment 4.
Figure 7B:
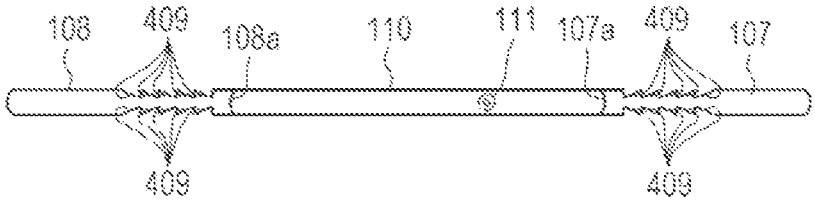
Figure 7C:
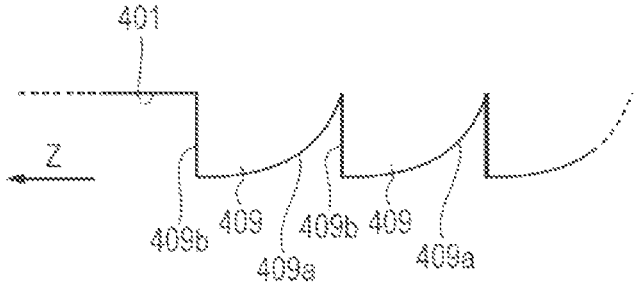

FIGS. 7A to 7C show ink-jet head 400 according to the present embodiment. In ink-jet head 400, projections 409 are arranged sequentially with no planar internal wall surface 401 arranged between the projections. Except for this feature, ink-jet head 400 is configured in the same way as ink-jet head 300 of Embodiment 3.

The present embodiment provides the same effects as Embodiment 3. According to the present embodiment, compared to Embodiment 3, larger number of projections 409 can be arranged, which is more effective to increase pressure in pressure chamber 110.

Embodiment 5

Figure 8A:
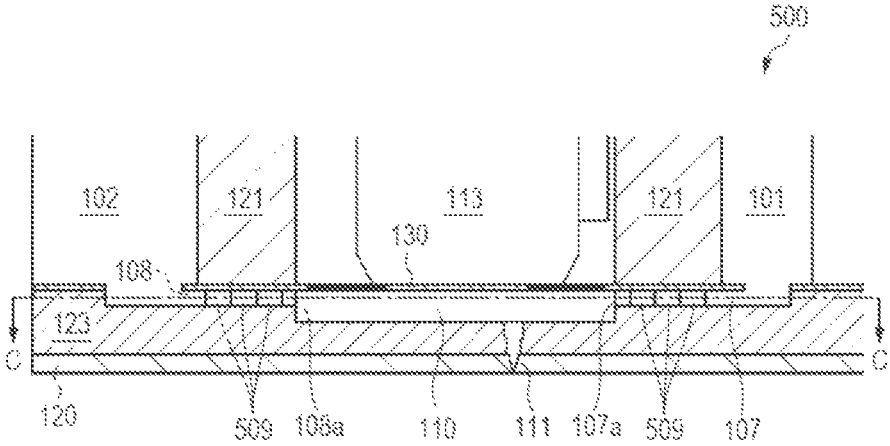
FIGS. 8A to 8C show an ink-jet head according to Embodiment 5.
Figure 8B:
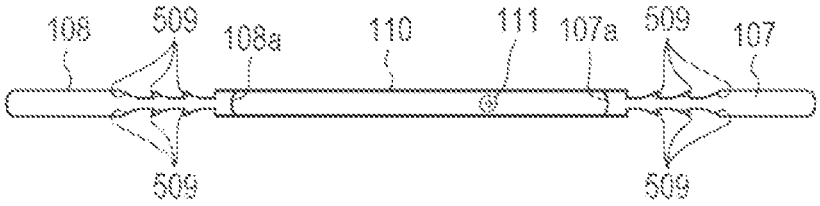
Figure 8C:
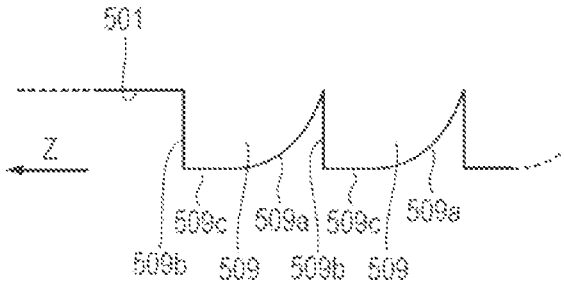

FIGS. 8A to 8C show ink-jet head 500 according to the present embodiment. In ink-jet head 500, each of projections 509 includes parallel section 509*c* that is parallel to planar internal wall surface 501 of the ink channel, between inclining section 509*a* and widening section 509*b*. Except for this feature, ink-jet head 500 is configured in the same way as ink-jet head 400 of Embodiment 4. Parallel section 509*c* constitutes the above-described straight section.

Here, as shown in FIG. 12B, the start point and end point of inclining section 509*a* in the Z direction are defined as r1 and r2, respectively. Further, the start point and end point of widening section 509*b* in the Z direction are defined as s1 and s2, respectively. Intersection angle α2 at end point r2 of the line connecting r1 with r2 and part of straight line Ax that is parallel to the ink channel axis, the part of the straight line Ax having end point r2 as the end point in the Z direction, is 45°, for example. Further, intersection angle β2 at start point s1 of the line connecting s1 with s2 and part of the straight line Ax, the part of the straight line Ax extending from s1 in the Z direction, is 90°. Further, inclining section 509*a* is formed by a convexedly curved line, and widening section 509*b* is formed by a straight line.

The present embodiment provides the same effects as Embodiment 3. According to the present embodiment, compared to Embodiment 3, a channel having a cross sectional area of the above-described shrinking section is made longer, which is more effective to increase a pressure in pressure chamber 110.

Embodiment 6

Figure 9A:
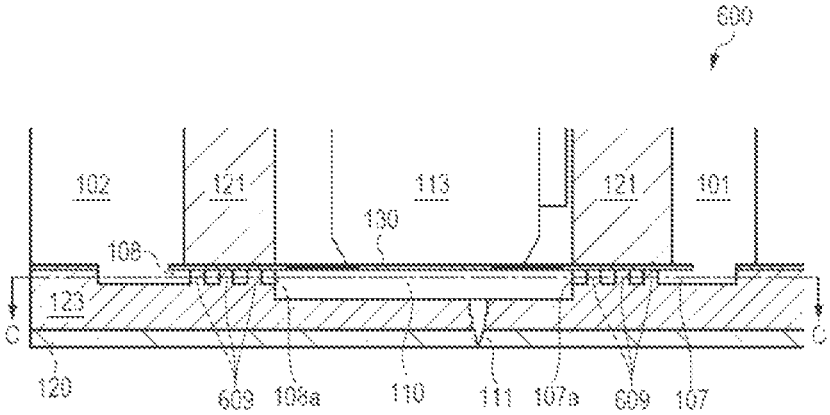
FIGS. 9A to 9C show an ink-jet head according to Embodiment 6.
Figure 9B:
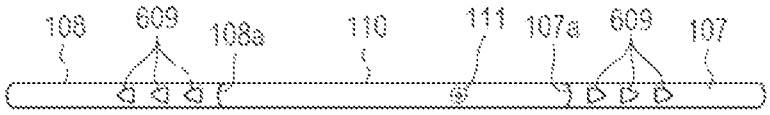
Figure 9C:
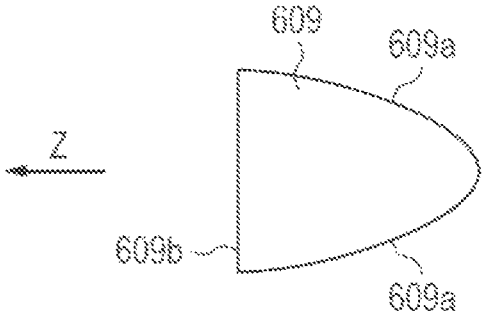

FIGS. 9A to 9C show ink-jet head 600 according to the present embodiment. Ink-jet head 900 includes islands 609 in the ink channel, instead of the projections. As shown in FIGS. 9A and 9B, ink-jet head 600 includes multiple islands 609 arranged intermittently in the ink channel along the direction of the ink channel axis. Islands 609 can be formed by, for example, cutting spacer 123 while leaving islands 609 when forming the ink channel.

As shown in FIGS. 9B and 9C, island 609 includes a pair of inclining sections 609*a* that gradually become closer to the internal wall surface of the ink channel from the center section of the ink channel and a pair of widening sections 609*b* that widens from the end of pressure chamber 110 side of each inclining section 609*a* toward the center section of the ink channel. Inclining section 609*a* forms a convexedly curved surface from the center section toward the internal wall surface of the ink channel in the planar direction of the ink channel. Widening sections 609*b* connect to each other at the center in the width direction of the ink channel to form a plane in the cross section of the ink channel.

Here, as shown in FIG. 12C, the start point and end point of inclining section 609*a* in the Z direction are defined as r1 and r2, respectively. Further, the start point and end point of widening section 609*b* in the Z direction are defined as s1 and s2, respectively. However, in island 609, the end point of inclining section 609*a* and the start point of widening section 609*b* share the same point. Intersection angles α3 and α3' at end points r2, r2 of the line connecting r1 with r2 and part of straight line Ax that is parallel to the ink channel axis, the part of straight line Ax having end point r2 as the end point in the Z direction, are 30° each, for example. Further, intersection angles β3 and β3' at start points s1, s1 of the line connecting s1 with s2 and the part of the straight line Ax, the part of the straight line Ax extending from s1 in the Z direction, are 90° each. Further, inclining section 609*a* is formed by a convexedly curved line as above-described, and widening section 609*b* is formed by a line.

In ink-jet head 600, the above-described shrinking section is formed between the internal wall surface of the ink channel and inclining section 609*a* of island 609. The above-described expanding section is formed by widening section 609*b*. The present embodiment provides the same effects as Embodiment 3.

The present embodiment provides the same effects as Embodiment 4 if islands 609 are sequentially arranged along the direction of the ink channel axis. Further, the present embodiment has the same effects as Embodiment 5 if island 609 has a parallel section between inclining section 609*a* and widening section 609*b*.

Embodiment 7

Figure 10A:
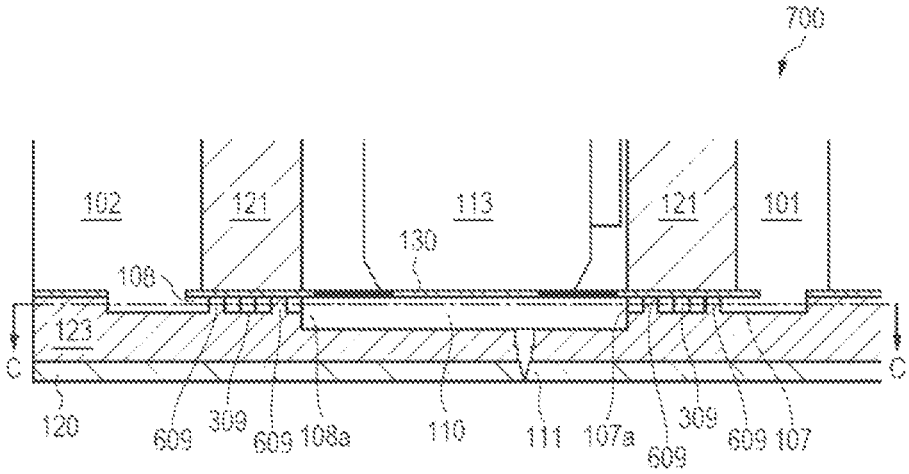
FIGS. 10A and 10B show an ink-jet head according to Embodiment 7.
Figure 10B:
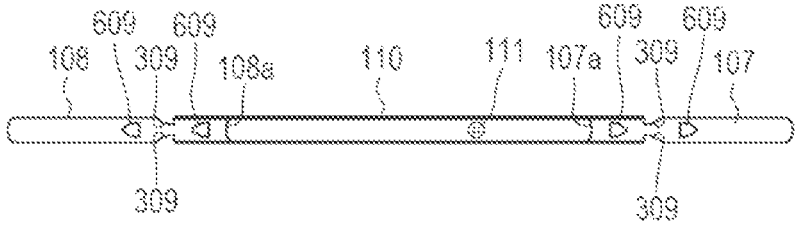

FIGS. 10A and 10B show ink-jet head 700 according to the present embodiment. Ink-jet head 700 includes both projections 309 in Embodiment 3 and islands 609 in Embodiment 6. That is, in the ink channel, island 609, projection 309, and island 609 are arranged intermittently from pressure chamber 110 side along the direction of the ink channel axis. Except for this point, ink-jet head 700 is configured in the same way as ink-jet head 300 of Embodiment 3.

The present embodiment provides the same effects as Embodiment 3. The present embodiment provides both of widening section 609*b* arranged at the center section in the width direction of the ink channel and widening section 309*b* arranged at both ends. Therefore, according to the present embodiment, the ink flow from pressure chamber 110 to the ink channel is further prevented. For this reason, compared to Embodiment 3 and Embodiment 6, the present embodiment is more effective to increase a pressure in pressure chamber 110.

Figure 11A:
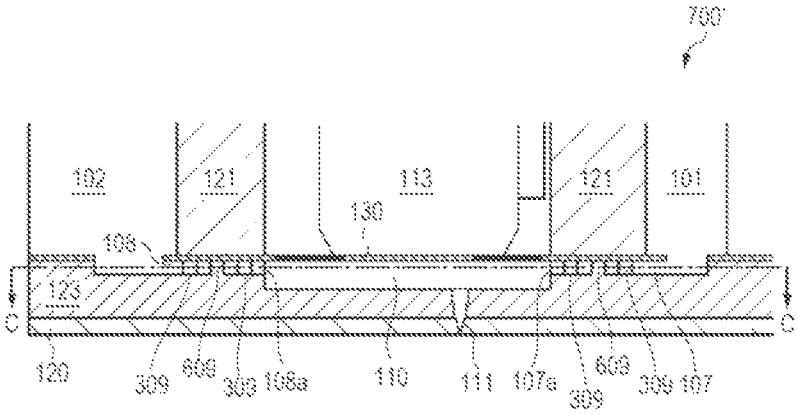
FIGS. 11A and 11B show a modification of an ink-jet head according to Embodiment 7.
Figure 11B:
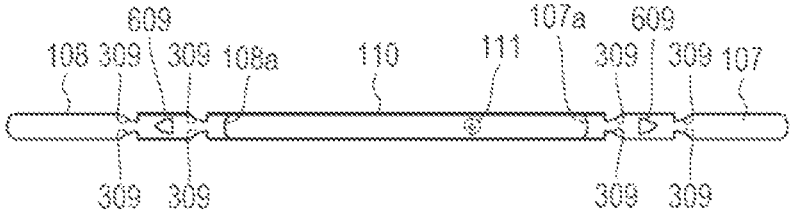

In Embodiment 7, as shown in FIGS. 11A and 11B, the position of projection 309 is replaced by that of island 609 and vice versa. Ink-jet head 700' having such configuration also provides the same effects as ink-jet head 700.

INDUSTRIAL APPLICABILITY

According to the ink-circulating ink-jet head of the present invention, the crosstalk is small, so that ink can be applied stably to an article to be coated with the ink. Accordingly, the ink-jet head of the present invention is suitable as an ink-jet head for applying an organic luminescent material for the manufacture of organic EL display panels, for example.

REFERENCE SIGNS LIST

100, 200, 300, 400, 500, 600, 700, 700' ink-jet head
101 ink supply channel
102 ink discharge channel
103 ink feed port
104 ink discharge port
107 ink inlet channel
107*a* inlet connection section
108 ink outlet channel
108*a* outlet connection section
109 unevenness
110 pressure chamber
111 nozzle
113 actuator
120 nozzle plate
121 upper plate
123 spacer
130 vibration plate
301, 401, 501 internal wall surface
309, 409, 509 projection
309*a*, 409*a*, 509*a*, 609*a* inclining section
309*b*, 409*b*, 509*b*, 609*b* widening section
609 island
Ax line parallel to the ink channel axis
r1 start point of the inclining section
r2 end point of the inclining section
s1 start point of the widening section
s2 end point of the widening section

The invention claimed is:

1. An ink-jet head comprising,
two or more pressure chambers configured to be supplied with ink and each having a nozzle for ejecting the ink;
an ink supply channel communicating with each of the pressure chambers and configured to allow the ink to flow to each of the pressure chambers;
an ink discharge channel communicating with each of the pressure chambers and configured to allow the ink flow, the ink being discharged from each of the pressure chambers;
an ink inlet channel connecting each of the pressure chambers to the ink supply channel;
an ink outlet channel connecting each of the pressure chambers to the ink discharge channel; and
an actuator arranged in each of the pressure chambers and for applying pressure to the ink in each of the pressure chambers,
wherein the nozzle is arranged between the ink inlet channel and the ink outlet channel, and
an inner surface of the ink outlet channel has unevenness.

2. The ink jet head according to claim 1, wherein an inner surface of the ink inlet channel has unevenness.

3. The ink jet head according to claim 1, wherein the inner surface of the ink outlet channel is composed of an elastic member and the inner surface of the ink outlet channel has unevenness.

4. The ink-jet head according to claim 1,
wherein both the ink inlet channel and the ink outlet channel define a linear path, and
a connection section connecting the ink inlet channel and each of the pressure chambers and a connection section connecting the ink outlet channel and each of the pressure chambers face each other, and a straight line passing through the ink inlet channel also passes through the ink outlet channel.

5. The ink jet head according to claim 1, wherein the ink inlet channel and the ink outlet channel are formed in a shape so that an energy loss of the ink flowing out from each of the pressure chambers is higher than an energy loss of the ink flowing into each of the pressure chamber.

6. An ink jet apparatus comprising the ink jet head according to claim 1.

7. The ink jet head according to claim 1, wherein the inner surface of the ink outlet channel includes projections of height of 1-30 μm.

8. The ink jet head according to claim 2, wherein the inner surface of the ink inlet channel includes projections of height of 1-30 μm.

9. The ink jet head according to claim 1, wherein the ink jet head is an ink-circulating ink jet head in which an ink in the pressure chamber is configured to be circulated to the ink supply channel via the ink discharge channel.

10. The ink jet head according to claim 1, wherein both the ink inlet channel and the ink outlet channel have a straight shape and not being bent, and a connection section connecting the ink inlet channel and each of the pressure chambers and a connection section connecting the ink outlet channel and each of the pressure chambers face each other, and a straight line passing through the ink inlet channel also passes through the ink outlet channel.

11. The ink jet head according to claim 1, wherein the inner surface of the ink outlet channel comprises a concavity and a convexity.

12. The ink jet head according to claim 2, wherein the inner surface of the ink inlet channel comprises a concavity and a convexity.

13. The ink jet head according to claim 1, wherein the inner surface of the ink outlet channel comprises an asperity.

14. The ink jet head according to claim 2, wherein the inner surface of the ink inlet channel comprises an asperity.

15. The ink jet head according to claim 1, wherein the inner surface of the ink outlet channel is a corrugated surface.

16. The ink jet head according to claim 2, wherein the inner surface of the ink inlet channel is a corrugated surface.

17. The ink jet head according to claim 1, wherein the elastic member comprises rubber, plastic, asphalt polymer materials, or combinations thereof.

* * * * *